US010118211B2

(12) United States Patent
Flehmig

(10) Patent No.: US 10,118,211 B2
(45) Date of Patent: Nov. 6, 2018

(54) METHOD AND DEVICE FOR FORMING A COLLAR ON A WORKPIECE

(71) Applicants: THYSSENKRUPP STEEL EUROPE AG, Duisburg (DE); thyssenkrupp AG, Essen (DE)

(72) Inventor: Thomas Flehmig, Ratingen (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/548,374

(22) PCT Filed: Feb. 1, 2016

(86) PCT No.: PCT/EP2016/052042
§ 371 (c)(1),
(2) Date: Aug. 2, 2017

(87) PCT Pub. No.: WO2016/124528
PCT Pub. Date: Aug. 11, 2016

(65) Prior Publication Data

US 2018/0036784 A1 Feb. 8, 2018

(30) Foreign Application Priority Data

Feb. 6, 2015 (DE) ..... 10 2015 101 717

(51) Int. Cl.
*B21D 19/08* (2006.01)
*B21D 24/16* (2006.01)
(Continued)

(52) U.S. Cl.
CPC ..... *B21D 24/16* (2013.01); *B21D 19/088* (2013.01); *B21D 22/08* (2013.01); *B21D 22/22* (2013.01); *B21D 22/30* (2013.01)

(58) Field of Classification Search
CPC ..... B21D 19/08; B21D 19/088; B21D 22/06; B21D 22/22; B21D 28/343; B21D 35/001
See application file for complete search history.

(56) References Cited

U.S. PATENT DOCUMENTS 1,613,961 A 1/1927 Schwartz
4,956,989 A * 9/1990 Nakajima ..... B21D 22/04 72/327
6,457,340 B1 10/2002 Kanemitsu

FOREIGN PATENT DOCUMENTS

CN 101080577 A 11/2007
CN 103157712 A 6/2013
(Continued)

OTHER PUBLICATIONS

English translation of International Search Report issued in PCT/EP2016/052042 (dated Mar. 24, 2016 dated Apr. 22, 2016).
(Continued)

*Primary Examiner* — Debra Sullivan
(74) *Attorney, Agent, or Firm* — thyssenkrupp North America, Inc.

(57) ABSTRACT

The problem of achieving great collar lengths with good quality and even when using high-strength metals, in particular high-strength steels, in a simple manner is solved by the disclosed methods and devices. One such method for producing a collar on a workpiece may involve preforming a region of the workpiece to form a material reserve for a collar drawing operation and drawing the workpiece to form a collar such that the drawn workpiece comprises a flange region and a drawn region adjoining the flange region, with the drawn region including a wall region and an adjoining drawn base. At least some material from a region of the material reserve may be used to form the wall region. The method may further involve punching the drawn base such that an opening is made in the drawn base and the wall
(Continued)

region is adjoined by a drawn base sub-region, as well as widening the drawn base sub-region.

16 Claims, 8 Drawing Sheets

(51) Int. Cl.

| | |
|---|---|
| ***B21D 22/22*** | (2006.01) |
| ***B21D 22/08*** | (2006.01) |
| *B21D 22/30* | (2006.01) |

(56) References Cited

FOREIGN PATENT DOCUMENTS

| | | | | | |
|---|---|---|---|---|---|
| DE | 102006029124 | A | | 12/2007 | |
| DE | 102008017728 | A | | 10/2009 | |
| DE | 102011117066 | A | | 5/2013 | |
| EP | 2186580 | A | | 5/2010 | |
| GB | 1162388 | A | * | 8/1969 | ..... B21K 1/64 |
| GB | 1539793 | A | | 2/1979 | |
| JP | S5155856 | U | | 5/1976 | |
| JP | H0252124 | A | | 2/1990 | |
| JP | 2006205232 | A | | 8/2006 | |
| JP | 2015112609 | A | | 6/2015 | |
| SU | 1562043 | A | | 5/1990 | |

OTHER PUBLICATIONS

English abstract for DE102006029124.
English abstract for DE102008017728.
English abstract for DE102011117066.

* cited by examiner

METHOD AND DEVICE FOR FORMING A COLLAR ON A WORKPIECE

CROSS REFERENCE TO RELATED APPLICATIONS

This application is a U.S. National Stage Entry of International Patent Application Serial Number PCT/EP2016/052042, filed Feb. 1, 2016, which claims priority to German Patent Application No. DE 10 2015 101 717.2 filed Feb. 6, 2015, the entire contents of both of which are incorporated herein by reference.

FIELD

The present disclosure generally relates to collars on workpieces, including methods and devices for producing collars on workpieces.

BACKGROUND

Collars or necks are required on workpieces, such as billets or other finished parts, for various purposes, for example as guide supports, stiffening supports, or thread supports. The collar required for this is for example produced by means of a forming method on the workpiece, so called collar drawing or necking.

Whenever an exact form of the collar is important, such as its length or its diameter, first a punching of the workpiece may be performed, for example. Next, using a partly conical, pointed or rounded collar stamp, the previously created hole can be widened, generally forming a collar perpendicular to the workpiece. The degree of the widening can be made dependent on the collar length to be achieved and/or the size of the widening to be attained.

In the event that the collar length and/or the edges of the collar need not meet any particular quality demands, it is known alternatively to form the collar without previous punching of the workpiece, for example by means of flowdrilling or pressing. In the event of flowdrilling, it is possible to increase the length of the collar on account of a local bulk forming and the thus increased material reserve and an incremental forming, but at times the dimensional stability and precision of the necking suffers in this way.

However, when producing the collar without local bulk forming it should be kept in mind that the widening of material constitutes a substantial strain on the particular material, since the edge regions in particular are extremely stretched. If the stretching ability of the material is exceeded in this process, locally either limit strain will occur with reduced application possibilities or the material will fail, cracking or breaking open in the region of the collar.

Thus, the hole widening capability is dependent not only on the initial dimension of the hole or the dimension to be attained, but also on the material itself, which sets limits on the achievable collar size and/or collar length. Thus, for example, soft deep-drawing steels have a good hole widening capability. Accordingly, the hole widening capability is less in the case of high-strength steels, so that in consequence the collar length achievable with these materials may be greatly limited in particular.

Yet in order to increase nevertheless the achievable collar length, it is known for example from the document U.S. Pat. No. 1,613,961, in order to avoid cracks during the forming of necks, to first form a hole or opening in a flat metal sheet. Next, the sheet is placed in a die and the opening of the flat punched sheet is widened by means of a conical stamp and a collar is formed. The material around the hole should be sufficient to form the collar with the desired length.

From document DE 10 2006 029 124 A1 there is likewise known a method and a device for necking of sheet metal by using a stamp and an anvil, in which the forming height of the necked collar should be obtained in a secure process. A flat metal sheet provided with a hole is placed in a device and a collar is formed there by means of a stamp and a die. Improved process safety is supposed to be achieved in that an anvil has a hinged design, in order to better lie against the metal sheet.

However, the approaches thus far for the forming of collars, especially in terms of their length, are either not satisfactory enough or the implementation is relatively costly, for example, by the implementation of hydroforming. Therefore, there continues to be a need to make possible increased collar lengths, even for high-strength and other metals or high-strength steels, but without having to resort to rather costly methods such as hydroforming.

Especially in the case of an unfavorable drawing condition, such as when the original workpiece diameter or the flange region is large in comparison to the diameter of the deep-drawn region, there continues to be a need to enlarge the attainable collar length.

Thus, a need exists for a method and a device for producing a collar on a workpiece, wherein great collar lengths with good quality can be achieved in simple manner, even when using high-strength metals, in particular high-strength steels.

DETAILED DESCRIPTION

Figure 1:
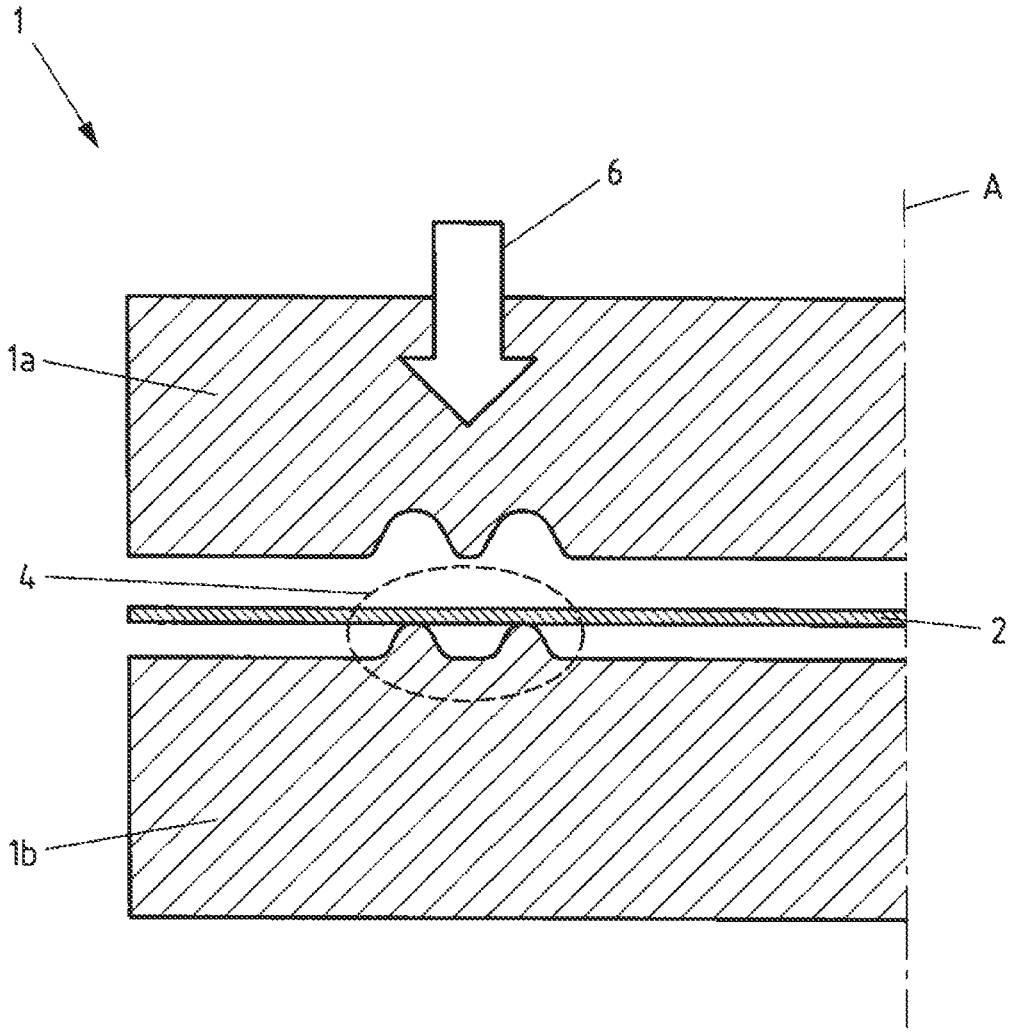
FIG. 1 is a schematic sectional view of an example first die or die portion of an example device prior to forming a material reserve.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' clement in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One way in which the problems set forth in the Background above may be solved is by way of an exemplary generic method that comprises the following steps: preforming a region of the workpiece to form a material reserve for a collar drawing operation, drawing the workpiece to form a collar, wherein the drawn workpiece comprises a flange region and a drawn region adjoining the flange region, wherein the drawn region comprises a wall region and a drawn base adjoining the wall region, and wherein at least some of the material from the region of the material reserve serves for forming the wall region, punching the drawn base located in the drawn region of the workpiece, such that an opening is made in the drawn base and the wall region is adjoined by a drawn base subregion, and widening the drawn base subregion.

On the one hand, it has been discovered to be advantageous, when forming a collar or necking, to employ the wall region created by means of at least one collar drawing operation in combination with a widened drawn base subregion in order to form longer and precise collars when necessary, since both the wall region and the widened drawn base subregion form at least a portion of the collar. For example, the collar encompasses the wall region and the widened drawn base subregion. It is especially advantageous that the method can be easily implemented in existing press-supported method steps, since in particular the collar drawing and the widening can be realized by a drawing die.

On the other hand, it has been discovered that, by providing a preforming step, a region of the workpiece can be formed such that as a result a material reserve can be formed for a subsequent collar drawing operation. In this way, in combination with the steps of collar drawing, punching and widening, even for high-strength materials, the collar length can be increased especially effectively. With the method, more material can be drawn into the wall region than was formerly known. Thus, the method can meet high quality demands for the collar. Likewise, the base region is not excessively thinned out, so that base cracks are avoided, even for rather large collar lengths.

Thanks to the material reserve, modifications or adaptations are performed on the workpiece which may serve especially for supporting the collar drawing operation. For example, additional material can be provided in this way and/or the flowing of the material into the drawn region can be facilitated. For example, thanks to the preforming to form a material reserve, the material can be heaped up in the region of the material reserve so that additional material is available for the collar drawing. For example, a special geometry of the workpiece can be provided in the region of the material reserve, which favors the collar drawing. The material of the material reserve can flow in particular into the wall region during the collar drawing. Preferably, the material reserve is used up after the drawing of the workpiece to form a collar.

The workpiece preferably consists of metal, especially steel. The steel may be both soft deep-drawing steels and medium-strength or high-strength steels. The workpiece for example may be a substantially flat, especially unpunched billet, a metal sheet, a semifinished piece, or a nearly finished component. Then with the method a collar can be formed very efficiently directly on the billet. The collar drawing in the context of the method is then for example a single-stage collar drawing operation. However, the workpiece can also be an already formed, for example a drawn workpiece, such as a finished part. Thus, the collar drawing can be carried out in multiple stages, for example in different dies, in order to further enlarge the collar length or perform the individual steps of the method in a flexible manner. The collar drawing in the context of the method then constitutes, for example, the last collar drawing step. Thus, for example, the material reserve may be formed prior to the start of the collar drawing or prior to the last collar drawing step.

The method may be, for example, part of a cold forming or hot forming, or be integrated in such. For example, the preforming to form the material reserve, the collar drawing, the punching and/or the widening may be done as hot forming or cold forming.

To enhance the process safety and the collar quality, the width of the drawn base subregion in the radial direction, that is, especially transversely to the collar drawing direction, corresponds preferably at most to the maximum widened width of the material.

The collar drawing can be done for example by means of a drawing die and a forging die adapted to it. The forging die comprises for example a necking contour, in which the wall region can be formed, so that the collar drawing may occur in a process-safe manner during the forming of the collar. The punching is done preferably by means of a blanking punch. Preferably, a combined drawing and blanking die is used, comprising on the bottom of the drawing die a cutting edge, preferably a rounded cutting edge, so that the punching can also be done with this die.

According to a preferred embodiment of the method of the invention, the region of the material reserve lies at least partly outside the region to be drawn. By the region to be drawn is meant in particular the contact region of the drawing die with the workpiece. Preferably, the region of the material reserve lies entirely outside the region to be drawn. For example, the region of the material reserve is provided in the flange region. In this way, the region of the material reserve can be provided at a definite distance from the collar drawing region and material can be made available in process-safe manner during the collar drawing.

Alternatively or additionally, the region of the material reserve may also be formed in the region to be drawn, that is, in the region of the drawn base, so that a thinning out in the region of the base drawing radius in particular can be counteracted.

According to another embodiment of the method of the invention, one or more elevations, especially in the form of beads, are formed by the preforming of the region to form the material reserve. For example, one or more encircling, especially concentric elevations, especially in the form of beads, are formed around the region to be drawn. Preferably at least two concentric beads are provided encircling the region to be drawn. It has been discovered that such a preforming on the one hand can be done quickly and results in fast cycle times, and on the other hand it enables the forming of the necessary material reserve in satisfactory manner. For example, the elevations are provided contrary to the collar drawing direction, so that the workpiece can be placed securely against the die for the collar drawing, despite the elevations.

Basically, however, alternative configurations of the region of the material reserve are also conceivable, such as a material thickening or an elevation in the collar drawing direction.

For example, no elevations are present any longer at the end of the collar drawing. Thus, a preforming to form the region of the material reserve is only carried out to the extent needed in order to avoid excessive material stresses.

According to another embodiment of the method of the invention, the preforming of the region to form the material reserve is done in dependence on the properties of the workpiece and/or the collar form to be produced. Because the region of the material reserve is tailor-made in dependence on the collar form, a safe process of production of the collar can be accomplished at slight cost. For example, the geometry of the region of the material reserve is determined in dependence on the material and/or the thickness of the workpiece. For example, if one or more beads are provided in the region of the material reserve, the height, the width, and/or the form of the beads can be made dependent on the material and/or the thickness of the workpiece. Likewise, the spacing of the beads can be made dependent on the material properties. For example, the height of the beads is chosen such that the stretching ability of the material is not surpassed. Likewise, a length of the workpiece in the region of the material reserve created additionally by the preforming is dimensioned such that the stretching ability of the material is not surpassed.

According to another embodiment of the method of the invention, the preforming of the region to form the material reserve contains at least for a portion a prestretching to at most the yield limit of the material. It has been discovered that a prestretching of the material and the resulting additional length may improve the flow of material from the material reserve into the wall region and allow the material reserve to be easily and efficiently provided. Preferably, the stretching ability of the material will not be surpassed, or else the process safety and the quality would be impaired.

According to another embodiment of the method of the invention, the region of the material reserve corresponds substantially to the collar drawing length of the workpiece. By providing the region of the material reserve, an excessive thinning out or a material failure can be prevented, since additional material can now be made available for the collar drawing operation thanks to the material reserve. For example, the extension of the region or the cross-sectional length of the region corresponds substantially to the collar drawing length.

According to another embodiment of the method of the invention, the workpiece is subjected to a force, especially a controlled force, in the region of the material reserve during the collar drawing at least for a time and at least for a portion, for example by the hold-down clamp in the collar drawing direction. Thanks to the application of a force, especially a controlled force, the material reserve can be additionally pressed into the region to be drawn, which may further improve the material flow in particular into the wall region.

According to another embodiment of the method of the invention, the preforming of the region to form the material reserve occurs in a first die or die portion and at least the collar drawing occurs in a second die or die portion. In this way, the preforming of the material reserve region may be integrated in existing methods without major modifications of the collar drawing dies. In order to further shorten the cycle times, the first die may also be integrated optionally in other work steps, such as first collar drawing operations or trimming of the workpiece. Preferably, the collar drawing, the punching of the drawn base and the widening of the drawn base subregion occurs in the second die. In this way, the transport otherwise necessary between individual dies can be reduced to a minimum.

Preferably, therefore, at first the workpiece is placed in the first die, and at least the preforming is done to form the material reserve. The workpiece may then be removed and after this placed in the second die. For example, the workpiece is brought between a drawing die and a forging die with hold-down clamp. After the collar drawing, punching and widening of the workpiece, the workpiece with finished collar can be removed from the second die.

According to a second teaching of the present invention, the aforementioned problem is by a device for producing a collar on a workpiece, especially to carry out the method according to the invention, having preforming means for the preforming of a region of the workpiece to form a material reserve for a collar drawing operation, having collar drawing means, which are designed to draw the workpiece so that the workpiece comprises a drawn region adjoining a flange region with a wall region and with a drawn base adjoining the wall region, having punching means, which are designed to punch the drawn base so that a drawn base subregion is produced, adjoining the wall region, and having widening means, which are designed to widen the drawn base subregion.

As already mentioned, thanks to the combination of wall region and widened drawn base subregion it is possible on the one hand to form longer and precise collars, while the device can easily be realized by means of press-supported devices. On the other hand, by providing the preforming means it is possible to form a material reserve for a subsequent collar drawing operation, so that in combination with the means for collar drawing, punching and widening the collar length be especially effectively increased with the device, even for high-strength materials. Furthermore, high quality demands can be met, since enough material can be drawn into the wall region and thus the base region is not excessively thinned out.

Preferably, the device has means of fixation of the workpiece. The means of fixation of the workpiece may be designed so that the workpiece is fixed by its flange region in the device, especially during the collar drawing, punching and widening. The means of fixation may be realized, for example, with a hold-down clamp, especially a pressure-controlled one.

In order to integrate the forming of the region of the material reserve in existing methods with no significant modifications of the dies for the collar drawing, according to a preferred embodiment the device comprises a first die or a first die portion and a second die or a second die portion, wherein the first die or the first die portion comprises the preforming means and wherein the second die or the second die portion comprises the collar drawing means, the punching means and the widening means.

In order on the one hand to efficiently carry out the preforming of the region to form the material reserve and at the same time make possible the formation of the necessary material reserve, according to another embodiment of the device of the invention the preforming means to form the region of the material reserve are designed to form one or more elevations, especially in the form of beads, preferably with uniform radii.

According to another embodiment of the device of the invention, the device comprises means of applying force, especially controlled force, to the workpiece at least for a time and at least for a portion in the flange region during the collar drawing. The means of applying force may be realized, for example, by a hold-down clamp. Thanks to the application of a force, especially a controlled force, in the flange region and thus preferably in the region of the material reserve, the material can be forced from the region of the material reserve additionally into the region to be drawn, which may improve the material flow.

According to another embodiment of the device of the invention, the collar drawing means encompass a drawing die and the punching means encompass a cutting edge, especially a rounded one, arranged on the drawing die bottom, and a punching die arranged opposite the drawing die and adapted to the cutting edge. Thus, a combined drawing and blanking die is provided. The cutting edge for example protrudes in the collar drawing direction from the drawing die bottom and at a spacing from the drawing die edge. Furthermore, the drawing die may serve for the widening of the drawn base subregion. In this way, the production of the collar can be realized with short cycle times and without major modifications of existing press-supported devices. The collar drawing, punching and widening can be realized, for example, simply by a movement of the drawing die in a collar drawing direction.

Preferably, the collar drawing means furthermore comprise a forging die with a necking contour, so that the workpiece can be subjected to a drawing process by means of a relative movement of drawing die and forging die, so that the collar can be formed by the die along the necking contour.

Basically, the die may comprise different cross-sectional shapes, looking in the collar drawing direction, such as a round, oval, or polygonal cross section. Especially good results in terms of collar quality are achieved, however, when the drawing die comprises a substantially round cross section or is designed with rotational symmetry. For example, the preferably rounded cutting edge is arranged concentrically on the drawing die bottom. For example, first a cup-shaped drawn region may be created by means of the collar drawing and then a hub-shaped collar produced by the punching, for example. The drawn base may be formed basically parallel or slanting with respect to the flange region of the workpiece. Furthermore, the border line of the drawn base may be formed circular, wavy, or some other shape.

If the drawing die bottom apart from the cutting edge is substantially flat and extends transversely to the collar drawing direction, an unwanted excessive prestretching of the drawn base will be avoided and more material can flow from the flange region into the wall region.

For example, a circular, especially rounded cutting edge and a punching die, especially a sharp-edged one, adapted to it may be provided, so that a circular opening can be punched in the drawn base. However, other geometrical cross sections suitable for the punching can also be used here, such as oval or polygonal cross sections. The cross-sectional shapes used for the collar drawing and for the punching may coincide substantially, for example except for an offset, or different shapes may be used.

As already mentioned, according to a preferred embodiment the cutting edge is rounded. In this way, among other things, the drawing port bottom is advantageously undamaged by the cutting edge during the collar drawing and no notches are formed, for example, and no premature partial punching of the workpiece occurs. Instead, the material can at first slide across the cutting edge. In concert with the punching die, whose movement is inhibited contrary to the collar drawing direction, a punching of the drawn base then occurs at a definite time. This enhances the quality of the collar wall and the possible drawing depth.

Having a rounded cutting edge means, in particular, that the radius of the cutting edge is larger than 0.15 mm, especially larger than 0.25 mm, preferably as much as 1 mm. For example, the radius of the cutting edge is between 0.3 and 0.8 mm.

According to another embodiment of the device of the invention, an inhibiting member is provided, which serves for the temporary, especially defined application of force to the punching die in reaction to an action of force on the part of the drawing die in the collar drawing direction. Thanks to the inhibiting member, the drawn base can be punched at a definite time. Furthermore, because the application of force occurs only temporarily, a movement of the punching die in the collar drawing direction is possible, so that the widening is made possible after the punching.

For example, the device is designed so that a defined inhibiting force of the punching die exceeds the cutting force needed for the punching of the drawn base portion, in order to enable the punching. The inhibiting force may be exerted by the inhibiting member, for example.

For example, the inhibiting member is formed as a shoving wedge able to move transversely to the collar drawing direction, which inhibits the movement of the punching die in the collar drawing direction. For example, the shoving wedge when sufficient force is applied in the collar drawing direction can again release the movement of the punching die in the collar drawing direction, especially if the defined inhibiting force of the punching die surpasses the cutting force needed for the punching of the drawn base portion. For example, the shoving wedge is spring-loaded. For example, the shoving wedge and the punching die comprise sliding surfaces adapted to each other, enabling a sliding of the punching die along the shoving wedge and a displacement of the shoving wedge.

For example, the punching die is likewise spring-loaded in order to make possible additional force contrary to the collar drawing direction.

Regarding further advantageous embodiments of the device, reference is made to the description of the method and its benefits.

Thanks to the previous and the following description of steps of the method according to preferred embodiments of the method, corresponding means of carrying out the steps of the method shall also be disclosed by preferred embodiments of the device. Likewise, the disclosure of means for carrying out a step of the method will disclose the corresponding step of the method.

FIG. 1 shows a schematic view of a sample embodiment of a first die or die portion 1 of a device prior to the forming of a material reserve. The die or die portion 1 is shown in a partial longitudinal section, and is constructed symmetrically about the axis A. The die or the die portion 1 is installed in a suitable press, not represented here, and comprises with an upper forging die 1*a* and an adapted lower forging die or die 1*b* preforming means for forming a region 4 of a workpiece or workpiece section 2. The workpiece or the workpiece section 2 in the form of a billet or a metal sheet is placed between the forging dies 1*a*, 1*b* in the opened press. Thanks to the geometry of the pressing surfaces, a region 4 of the workpiece 2 can be shaped by the die 1 so that a material reserve is formed in the region 4 for a later collar drawing operation. For this, the upper forging die 1*a* for example is moved onto the lower forging die for the closing of the die 1 in the direction of the arrow 6.

Figure 2:
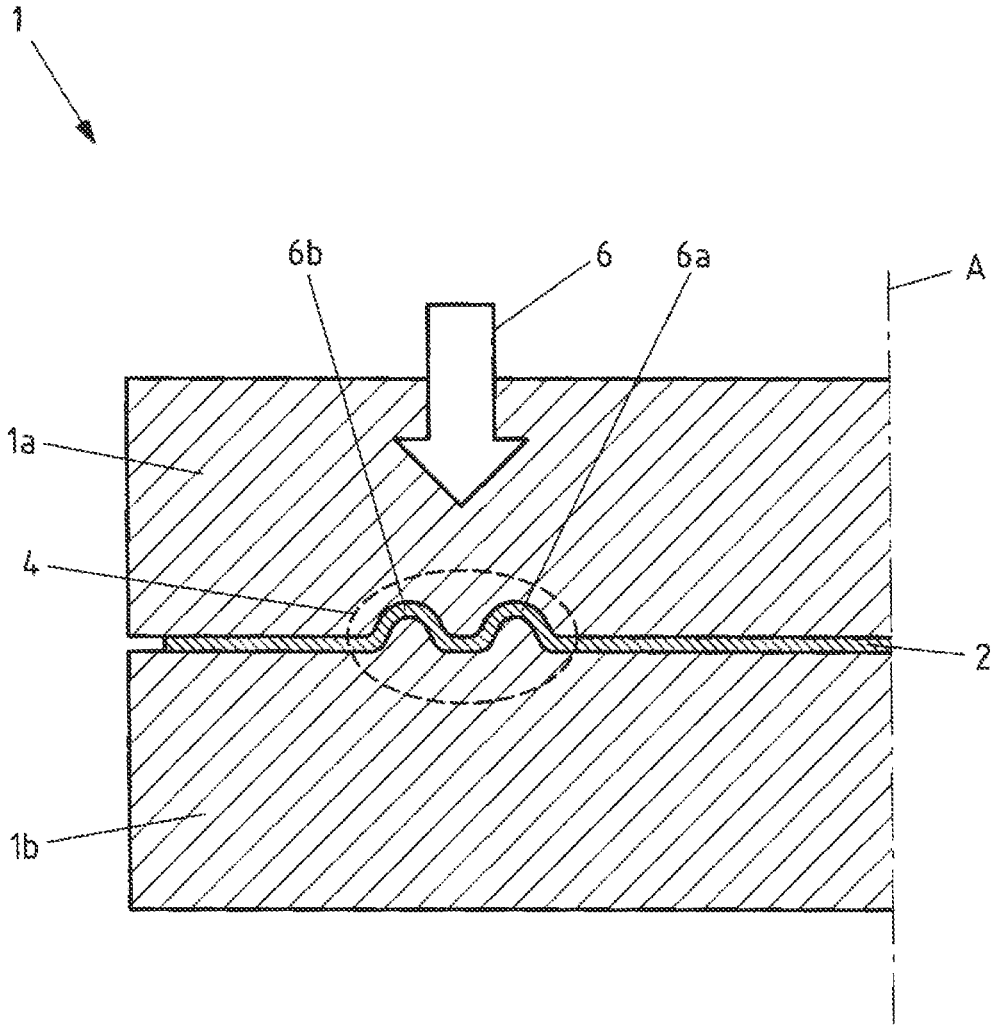
FIG. 2 is a schematic sectional view of the example first die or die portion of FIG. 1 after forming the material reserve.

FIG. 2 shows a schematic view of the first die 1 from FIG. 1 after the forming of a material reserve in the region 4 of the die 2. Thanks to the forming/preforming of the region 4, elevations have been formed in the depicted sample embodiment in the form of two concentric encircling beads 6*a*, 6*b*. The forming/preforming with the die 1 has caused a pre-stretching of the material in the region 4 of the beads 6*a*, 6*b* and the adjoining regions, resulting in a lengthening of the cross-sectional length in the region 4 of the workpiece or workpiece section 2. As a result, the region 4 with the beads 6*a*, 6*b* may serve as a material reserve for a later collar drawing operation.

Since the die 1 may also constitute a die portion of a more complex die, not represented, it is basically possible for it to undertake further machining steps, such as further forming, of the workpiece 2, during the closing of the press.

Figure 3:
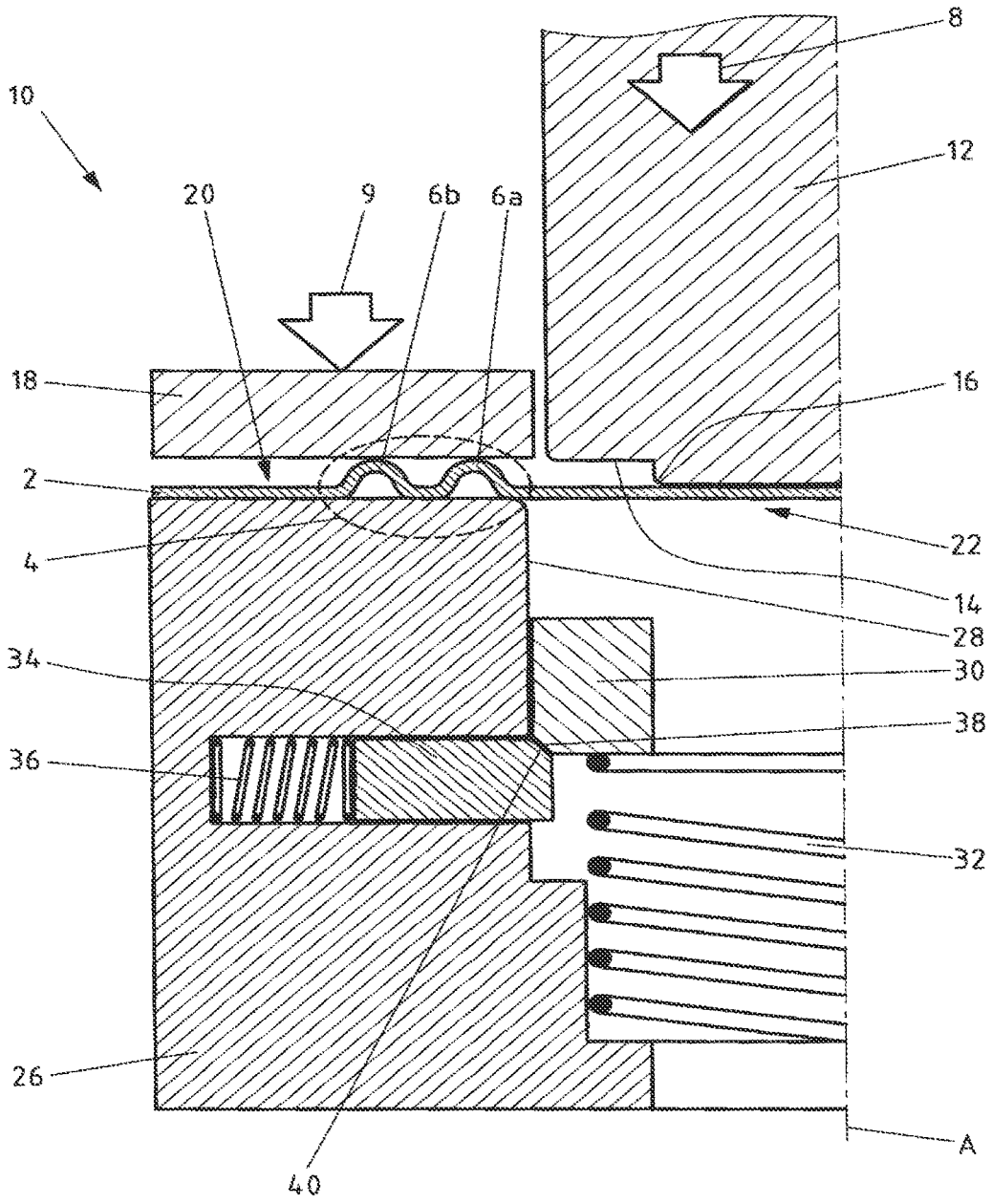
FIG. 3 is a schematic sectional view of an example second die or die portion of an example device prior to collar drawing.

FIG. 3 shows a schematic view of a sample embodiment of a second die 10 of a device prior to the collar drawing. The device 10 is likewise formed symmetrically about the axis A. It comprises means of drawing the workpiece 2 to form a collar with a drawing die or drawing and blanking die 12 able to move in the collar drawing direction 8. The drawing die has a rounded cutting edge 16 arranged on the drawing die bottom 14. The cutting edge 16 protrudes from the drawing die bottom 14 in the collar drawing direction 8. This avoids the danger of a premature damaging or punching of the workpiece 2.

The die 10 furthermore comprises, with the hold-down clamp 18, means of fixation of the workpiece 2. As shown by the arrow 9, the hold-down clamp can apply a controlled force to the workpiece 2 in a flange region 20 in the collar drawing direction 8. In this way, the workpiece 2 can be secured and material can be brought up from the region 4 of the material reserve.

The die 10 furthermore comprises a forging die 26, whose cross-sectional contour represents the necking contour 28 and is adapted to the drawing die 12. In the lower region of the forging die, a punching die 30 is spring-loaded and adapted to the cutting edge 16 in order to enable a punching of the drawn base portion 42. In addition, a spring element 32 is provided, which can apply a force to the punching die contrary to the collar drawing direction 8. Furthermore, an inhibiting member in the form of a shoving wedge 34 is mounted in the forging die 26. The shoving wedge braces the punching die 30 so that the movement of the punching die 30 is at first inhibited in the collar drawing direction 8. For this, the shoving wedge 34 presses with a spring element 36 under the punching die 30. The punching die 30 and the shoving wedge 34 comprise mutually adapted sliding surfaces 38, 40, enabling the punching die 30 to slide along the shoving wedge 34.

Figure 4:
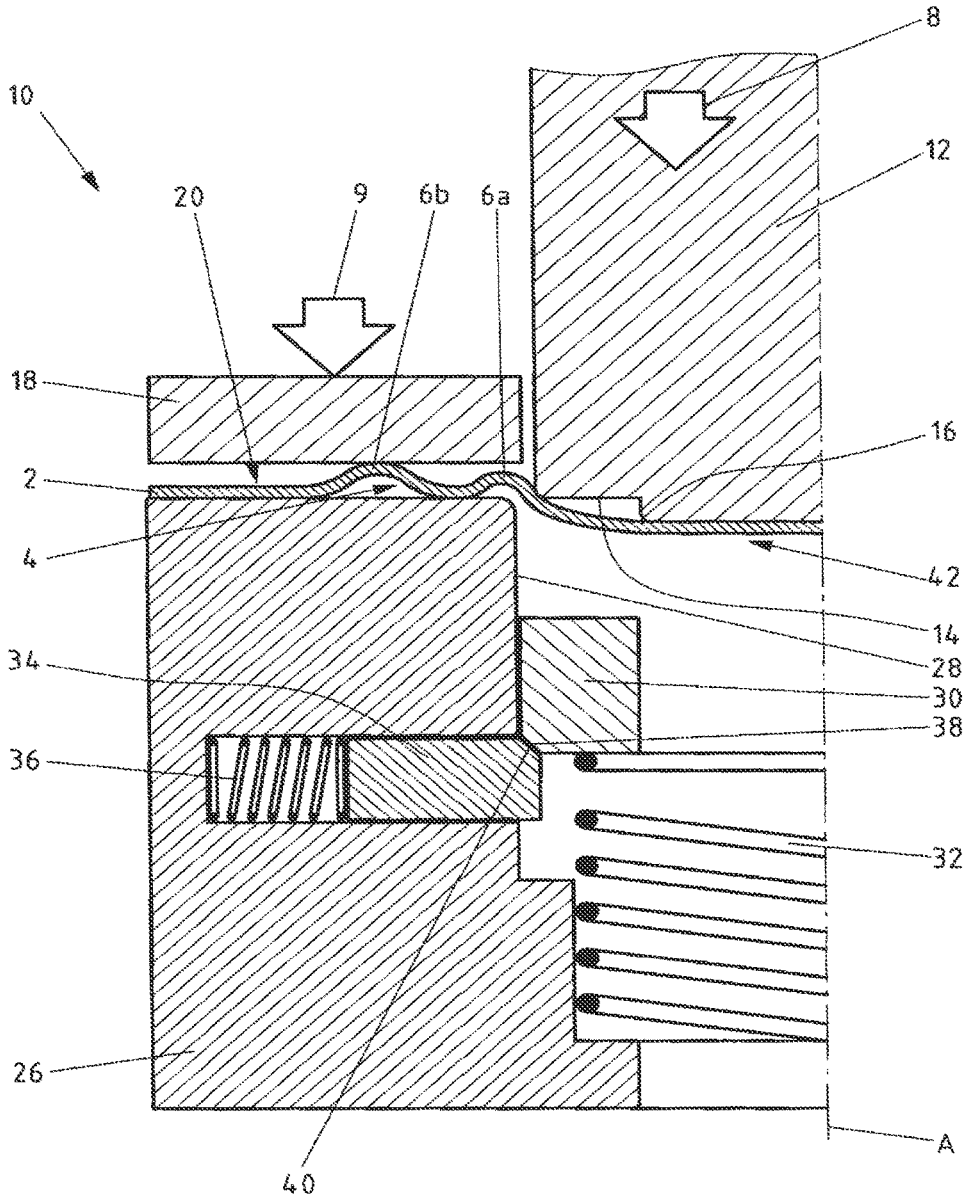
FIG. 4 is a schematic sectional view of the second die or die portion of FIG. 3 during a first stage of the collar drawing.
Figure 5:
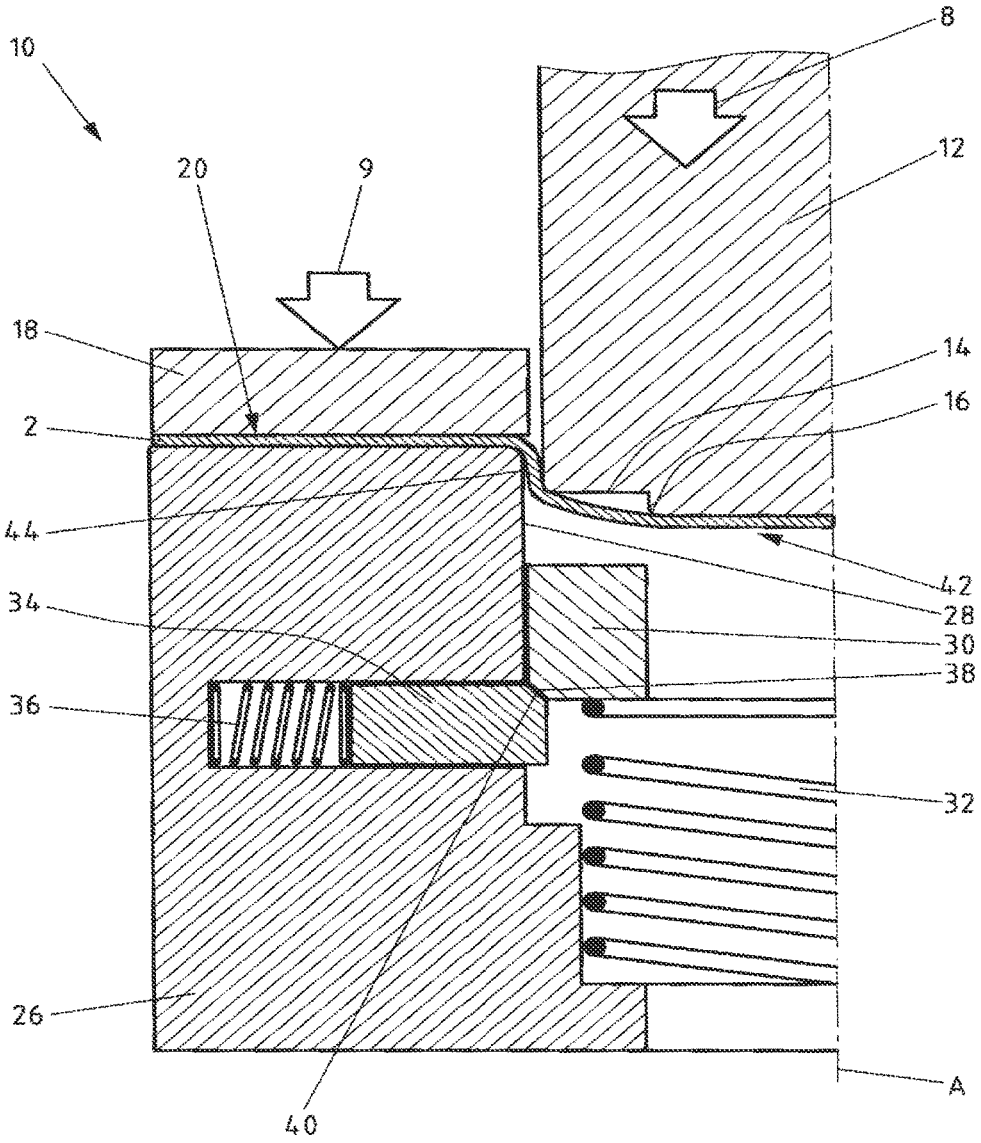
FIG. 5 is a schematic sectional view of the second die or die portion of FIG. 3 during a second stage of the collar drawing.

FIGS. 4 and 5 show a schematic view of the second die 10 from FIG. 3 during the collar drawing. The drawing die 12 here is moved in the collar drawing direction 8. In this way, a drawn region is formed in the workpiece 2 with a wall region 44 adjoining the flange region 20 and with a drawn base 42 adjoining the wall region. During the collar drawing, material is made available by the region 4 for the collar drawing operation and drawn into the wall region 44. At the same time, thanks to the application of force to the region 4 with the hold-down clamp 18, material of the material reserve is shoved into the wall region 44. In this way, the wall region 44 may be formed longer than with the conventional methods, while the drawn base 42 substantially does not become thinner. As can be seen in FIG. 5, the beads 6*a*, 6*b* are substantially smoothed out during the collar drawing.

Thanks to the providing of a rounded cutting edge 16, the drawn base 42 is not damaged or prematurely punched during the collar drawing and a thinning out of the drawn base 42 can be reduced or prevented by the substantially flat drawing die bottom 14 running transversely to the collar drawing direction 8.

During the progressive collar drawing operation, either further material is brought in from the flange region 20 to the wall region 44 and/or the wall region 44 is ironed out until the drawing die 12 has reached the punching die 30. Because of the counter force produced by the shoving wedge 34, the punching die 30 initially cannot move away and the cutting edge 16 of the combined drawing and blanking die 12 punches the drawn base 42, cutting or punching a slug 46 from the drawn base 42, which can drop out from the die 10 through the punching die and does not need to be manually removed.

Figure 6:
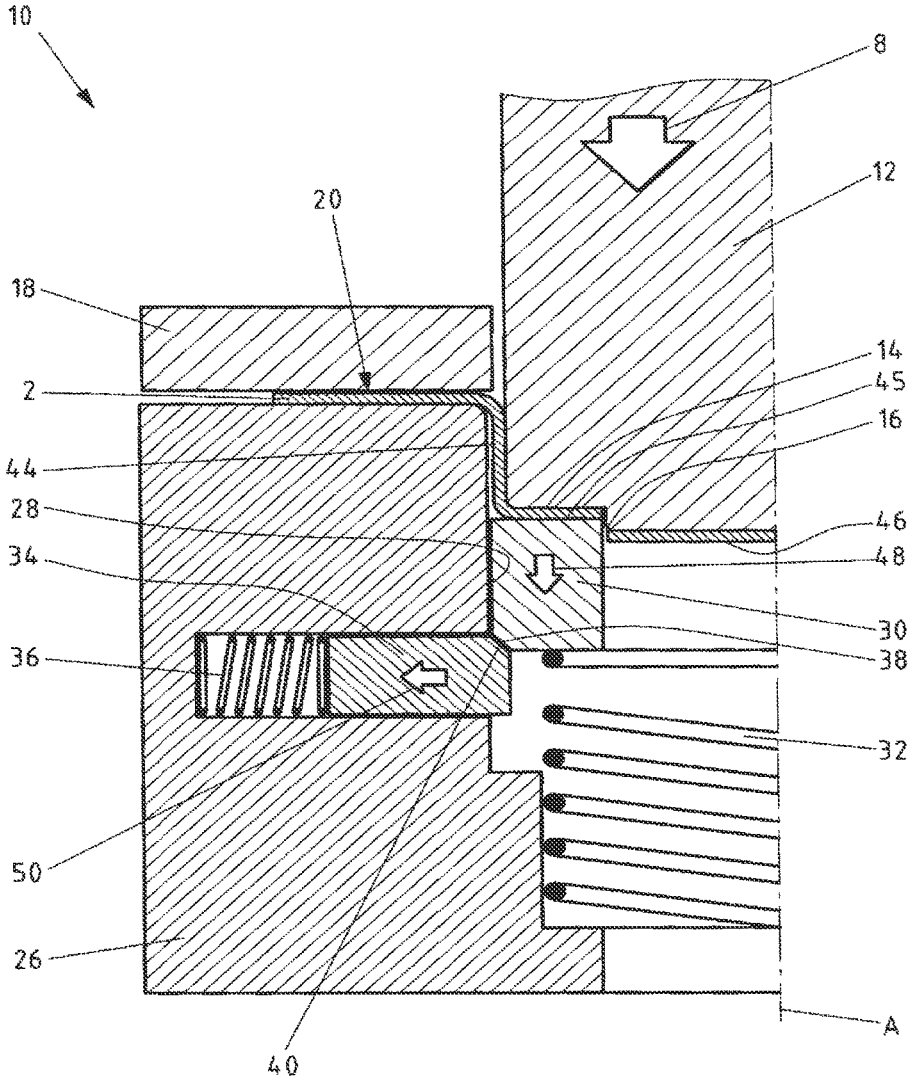
FIG. 6 is a schematic sectional view of the second die or die portion of FIG. 3 after punching.

FIG. 6 shows for this a schematic view of the second die or die portion 10 from FIG. 3 after the punching. The wall region 44 is now adjoined by a drawn base subregion 45. The counter pressure of the punching die 30 on the drawing die 12, however, is limited by the providing of the sliding surfaces 38, 40 on the punching die 30 and the shoving wedge 34 and by the spring loading of the shoving wedge 34 to the cutting force needed for the punching of the drawn base portion. If the force limit is surpassed, the shoving wedge 34 moves outward transversely to the collar drawing direction 8 in the direction of the arrow 48. The punching die 30 is further displaced downward in the collar drawing direction 8, as shown by the arrow 50, by the drawing die 12 and the drawing die 12 can bring about a widening of the drawn base subregion 45 by further advancement in the collar drawing direction 8.

Figure 7:
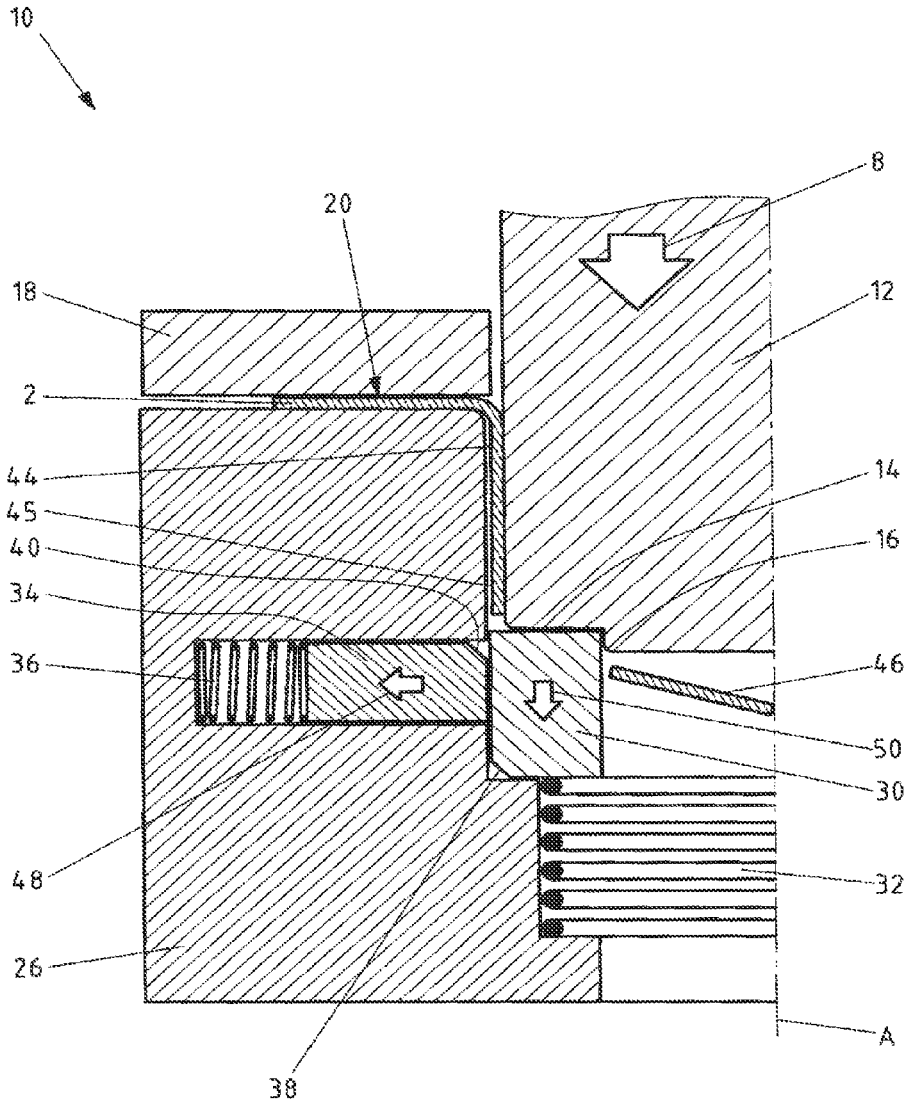
FIG. 7 is a schematic sectional view of the second die or die portion of FIG. 3 after widening.

FIG. 7 shows a schematic view of the second die or die portion 10 of FIG. 3 after the widening of the drawn base subregion 45. Because the collar contains length portions of the wall region 44 and the widened drawn base subregion 45, a longer collar can be formed, with no material failure, from the region 4 of the material reserve and the rounded cutting edge 16.

Figure 8:
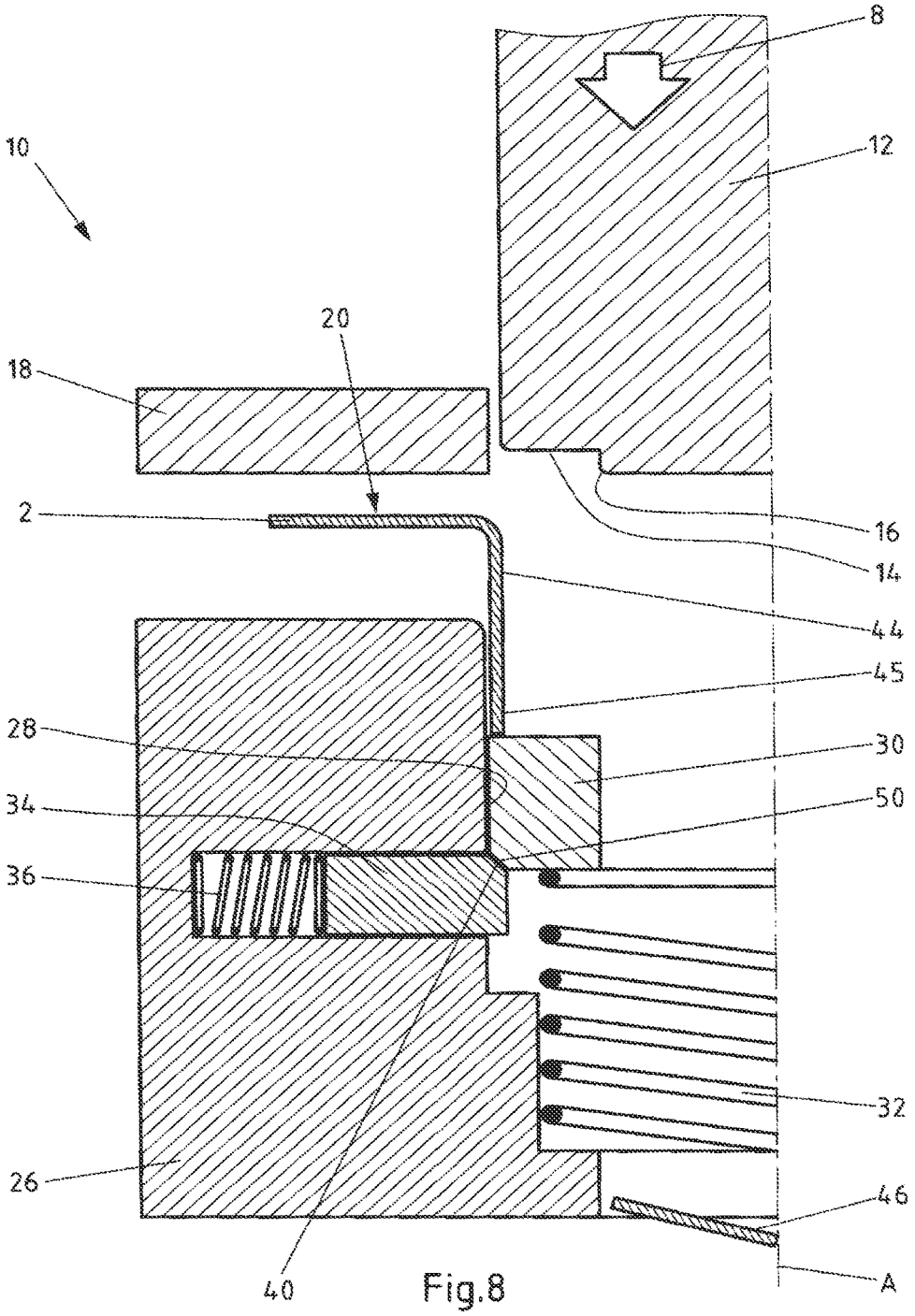
FIG. 8 is a schematic sectional view of the second die or die portion of FIG. 3 after ejecting.

With this, the formation of the collar is completed. By a lifting of the drawing die 12 and the hold-down clamp 18, the punching die 30 can again travel to the starting position against the collar drawing direction 8, whereupon the workpiece is ejected. FIG. 8 shows a schematic view of the second die or die portion 10 of FIG. 3 after the ejecting. The workpiece 2 here has been transported from the forging die 26 by the spring-loaded punching die 30 for removal from the die 10.

What is claimed is:

1. A method for producing a collar on a workpiece, the method comprising:

preforming, in a first die or first die portion, a region of the workpiece to form a material reserve for a collar drawing operation;

drawing the workpiece to form the collar, wherein the drawn workpiece comprises a flange region and a drawn region that adjoins the flange region, wherein the drawn region comprises a wall region and a drawn base that adjoins the wall region, wherein at least some material from the material reserve is used to form the wall region;

applying a force to at least a portion of the flange region of the workpiece during said drawing;

punching the drawn base in the drawn region such that an opening is made in the drawn base and the wall region adjoins a sub-region of the drawn base; and widening the sub-region of the drawn base, wherein the drawing, punching and widening of the workpiece to form the collar occurs in a second die or second die portion.

2. The method of claim 1 wherein the region of the material reserve lies at least partly outside a region of the workpiece to be drawn.

3. The method of claim 1 wherein the preforming comprises forming in the workpiece at least one elevation configured as a bead.

4. The method of claim 1 wherein the preforming of the region of the workpiece to form the material reserve is performed in a way that depends on properties of at least one of the workpiece or the collar to be produced.

5. The method of claim 1 wherein the preforming of the region of the workpiece to form the material reserve comprises pre-stretching at least a portion of the workpiece to at most a yield limit of the workpiece.

6. The method of claim 1 wherein the region of the material reserve corresponds substantially to a collar drawing length of the workpiece.

7. The method of claim 1 further comprising subjecting at least a portion of the workpiece to a force in the region of the material reserve during the drawing of the workpiece to form the collar.

8. The method of claim 1 wherein the material reserve is entirely and only formed by the first die or first die portion.

9. A device for producing a collar on a workpiece, the device comprising:

a first die or first die portion that comprises an upper die and a lower die configured to preform a region of the workpiece into a material reserve for a collar drawing operation; and a second die or second die portion that comprises a drawing die configured to draw the workpiece so that the workpiece comprises a drawn region that adjoins a flange region, the drawn region comprising a wall region and a drawn base that adjoins the wall region;

wherein the drawing die has a cutting edge configured to punch the drawn base to produce a sub-region of the drawn base that adjoins the wall region;

wherein the drawing die is configured to widen the sub-region of the drawn base; and a hold-down clamp configured to apply force to at least a portion of the flange region of the workpiece during the collar drawing operation.

10. The device of claim 9 wherein the upper and lower die and the drawing die are adapted to each other so that the region of the material reserve lies outside a region of the workpiece to be drawn.

11. The device of claim 9 wherein the upper and lower die include surfaces having a shape that corresponds to an elevation to be formed as part of the material reserve in the workpiece.

12. The device of claim 11 wherein the shape of the surfaces of the upper and lower die are configured to form beads in the workpiece.

13. The device of claim 9 wherein the cutting edge is disposed on a bottom of the drawing die, and a punching die is disposed opposite the drawing die and adapted to cooperate with the cutting edge to punch the drawn base.

14. The device of claim 13 wherein the cutting edge is rounded and the punching die is sharp-edged.

15. The device of claim 13 further comprising an inhibiting member for applying force to the punching die in response to a force exerted by the drawing die in a collar drawing direction.

16. The device of claim 15 configured such that a defined inhibiting force of the punching die exceeds a cutting force needed for the punching of the drawn base.

* * * * *